US010078930B2

(12) United States Patent
Kvinge et al.

(10) Patent No.: US 10,078,930 B2
(45) Date of Patent: Sep. 18, 2018

(54) NETWORKED DOOR CLOSER AND AUTO-OPERATOR

(71) Applicant: Schlage Lock Company LLC, Indianapolis, IN (US)

(72) Inventors: Kenneth A. Kvinge, Carmel, IN (US); Samir M. Tamer, San Jose, CA (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

(21) Appl. No.: 15/270,129

(22) Filed: Sep. 20, 2016

(65) Prior Publication Data

US 2018/0082503 A1 Mar. 22, 2018

(51) Int. Cl.
*G07C 9/00* (2006.01)

(52) U.S. Cl.
CPC ..... *G07C 9/00309* (2013.01); *G07C 9/00896* (2013.01); *G07C 2009/00793* (2013.01)

(58) Field of Classification Search
CPC ..... G07C 9/00111; G07C 9/00309; G07C 2009/00793; G07C 9/00103; G07C 9/00571; G07C 9/00182; G07C 2009/00634
USPC ..... 340/5.7
See application file for complete search history.

(56) References Cited

U.S. PATENT DOCUMENTS 6,422,463 B1 * 7/2002 Flink ..... G07C 9/00031 235/380
6,439,009 B1 * 8/2002 Heese ..... E05B 65/108 340/5.2
7,644,299 B2 * 1/2010 Kosaka ..... G06Q 20/206 705/18
8,009,041 B2 8/2011 Graichen
9,121,217 B1 9/2015 Hoffberg
9,141,099 B2 9/2015 Cate et al.
9,695,617 B2 * 7/2017 Bacarella ..... E05B 63/14
2003/0140666 A1 7/2003 Darcy et al.
2007/0273550 A1 11/2007 Price et al.
2010/0283579 A1 11/2010 Kraus et al.
2014/0069013 A1 3/2014 Wilson
(Continued)

OTHER PUBLICATIONS

International Search Report; International Searching Authority; International Patent Application No. PCT/US2017/052452; Mar. 19, 2018; 2 pages.

(Continued)

*Primary Examiner* — Mark Blouin
(74) *Attorney, Agent, or Firm* — Taft Stettinius & Hollister LLP

(57) ABSTRACT

An access control system for a plurality of door operators that are each respectively coupled to one of a plurality of doors providing an entrance to or exit from a building. A system controller monitors the status of each of the doors real time and controls the operation of each of the door operators based on the monitored status. The system controller adjusts the status of one or more door operators as a function of the determined status of one or more other door operators. Door operator commands are provided by the system controller to selected door operators to, for example, extend the opening time of one or more doors due to current activity by other door closers. The system controller is configured adjust the status of an entire group of doors or a sub-group group of doors depending on the status of the door operators.

24 Claims, 7 Drawing Sheets

(56) References Cited

U.S. PATENT DOCUMENTS

| | | | |
|---|---|---|---|
| 2015/0116082 | A1 | 4/2015 | Cregg et al. |
| 2015/0256604 | A1 | 9/2015 | Ruess et al. |

OTHER PUBLICATIONS

Written Opinion; International Searching Authority; International Patent Application No. PCT/US2017/052452; Mar. 19, 2018; 5 pages.

* cited by examiner

NETWORKED DOOR CLOSER AND AUTO-OPERATOR

FIELD OF THE INVENTION

The present disclosure relates to an access control system, and more particularly to a door operator control system.

BACKGROUND

Existing electronic door locks are used to provide access to different parts of a building or facility. Such door locks provide an entrance to a room, for instance, in response to mechanical or electrical actuation of a bolt extending from a door which engages a receiving portion of a frame. Electronic door locks can be isolated individual devices or can be found in an electronic lock system which provides electronic communication between the electronic lock and a control system. Some electronic locks systems are hardwired to an interface device which monitors and controls a state of the electronic lock. Other electronic lock systems include wireless electronic locks that communicate with a wireless interface device, also known as a panel interface module, sufficiently proximate to the electronic locks to enable radio communication. The interface device is configured to monitor and control the state of a predetermined number of electronic locks such that multiple interfaced devices can be included in a facility of a large size since one interface device can be insufficient to monitor and control all of the electronic locks in the facility. Consequently, a number of interface devices are hardwired to a central controller, sometimes known as an access control panel, and are connected to the computer system of the facility. In some facilities, more than one access control panel can be required. The computer system provides updates to the electronic locks through this radio communication network.

In addition to electronic door locks being used in association with a door, door operators are often provided to move the door from an open position to a closed position under control of a spring mechanism, a motor, a valve, or other actuators. Door operators include door openers, door closers, exits and auto-operators. In some configurations, the door operators are used in association with mechanical locks, and in other configurations the door operators are used in association with electronic locks, or no locks at all.

The door operator is coupled to the door and a door frame and is operable to open and/or close the door, or to locate the door at any position between the open and closed position, when provided an instruction or command. The door operator is configured to respond to an instruction or command made by a user interface button located at the door, either mechanical or touch sensitive, which is pressed. An instruction or command can also be provided by a card reader which authenticates a credential to operate the door. In another embodiment, a wall push pad located next to the door is pressed to open the door, which in turn activates the door operator. In another embodiment, a remote control device, operated by a user, opens the door when a button on the remote control device is activated.

Door operators, however, respond to a command provided by a user located at the door or in close proximity to the door. What is needed is a door operator that responds to a command or commands provided by other than the local or remote user.

SUMMARY

In one embodiment, there is provided a system, components, devices, and methods for communicating the status of one or more doors incorporating an electronic door operator in an electronic lock system, including determining and controlling the status of one or more door operators with respect to an entrance or an exit. Other embodiments include apparatuses, systems, devices, hardware, methods, and combinations for improving door status information in electronic lock systems.

As disclosed herein, the door operator system may include a plurality of door operators configured to communicate with: 1) a central control device, 2) distributed control devices, 3) one or more of the other door operators, and/or 4) the cloud. The door operator system operates as a cohesive, integrated system. Communication between devices of the door operator system, as well as communication of the door operator system with building control systems, is provided. The door operator system includes a baseline intelligence and decision making capability. In other embodiments, the door operator system includes a learning component configured to adjust to operational and environmental variances which are determined by door operators, door locks, or other sensor devices. In other embodiments, the door operators include a locking feature which holds the door in a closed position and prevents the door from opening. This locking feature is also controllable by the door operator system.

In one embodiment, there is provided a method of operating a plurality of door operators, each being configured to adjust a status of a door. The method includes identifying a current status of each of the plurality of door operators; identifying a changed status for at least one of the plurality of door operators; and modifying the current status of at least one other of the plurality of door operators based on the changed status.

In another embodiment, there is provided a method of operating a plurality of door operators, each being configured to adjust a status of a door. The method includes providing a plurality of door operators configured to be located at one of a plurality of doors and providing a schedule for door operator statuses. The schedule is configured to include a plurality of scheduled status changes scheduled over a period of time for each door operator, wherein the scheduled status changes are configured to modify the status of a door operator. The method further includes identifying a current status of each of the plurality of door operators, identifying a changed status for a first portion of the plurality of doors, and modifying the current status of a second portion of the plurality of doors operators based on the identified changed status.

In still another embodiment, there is provided an access control system for controlling the status of a plurality of doors. The system includes a plurality of door operators configured to change the status of the plurality of doors, wherein each of the door operators includes an actuator, a sensor, a transceiver, and a processor operatively connected to the actuator, the sensor, and the wireless transceiver. A master controller is operatively connected to each of the plurality of door operators, wherein the master controller includes a memory configured to store program instructions. The master controller configured to execute the stored program instructions to identify a current status of each of the plurality of door operators, to identify a changed status for at least one of the plurality of door operators, and to modify the current status of at least one other of the plurality of door operators based on the changed status.

BRIEF DESCRIPTION OF THE DRAWINGS

The description herein makes reference to the accompanying figures wherein like reference numerals refer to like parts throughout the several views, and wherein.

DETAILED DESCRIPTION

Figure 1:
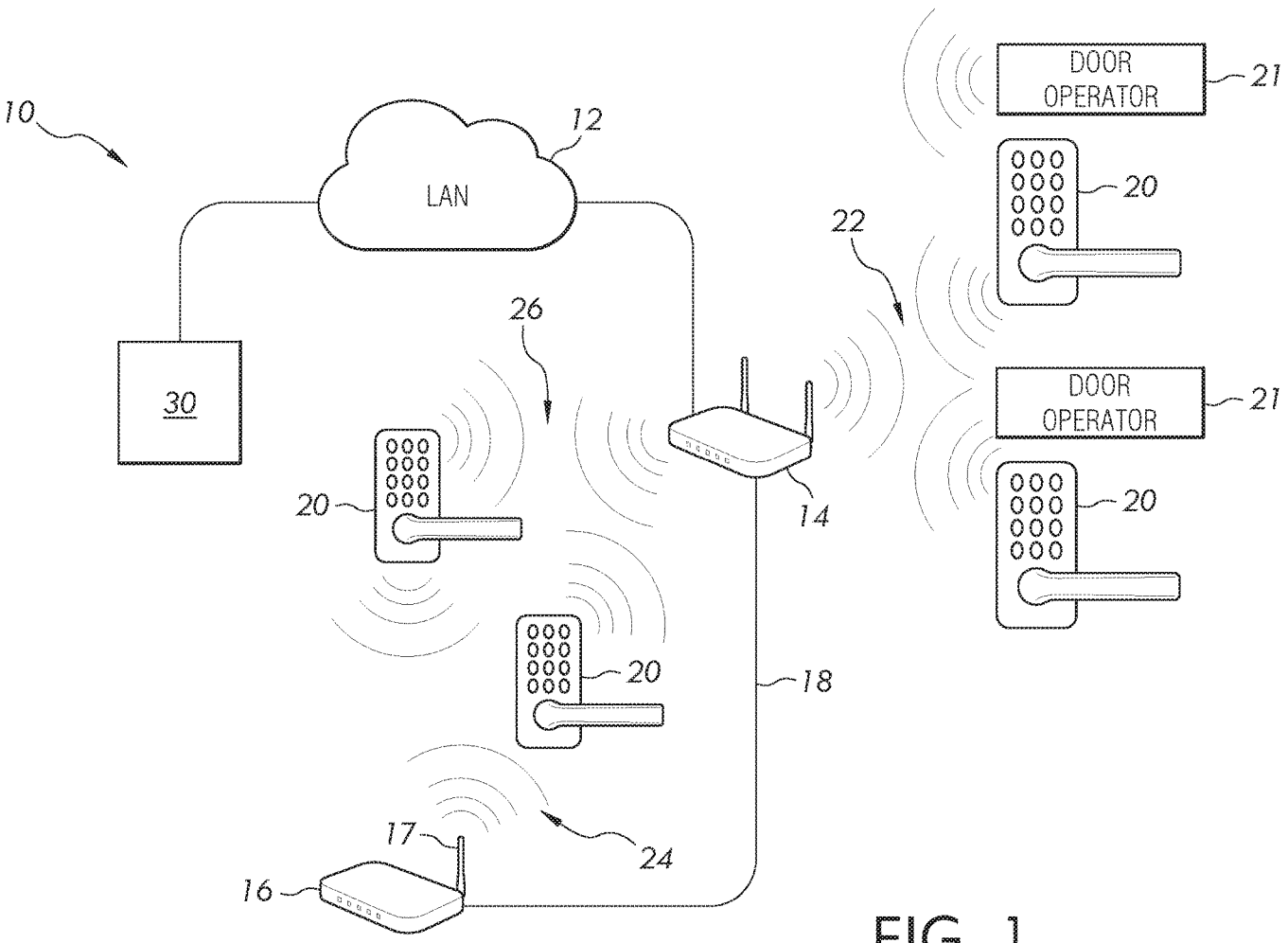
FIG. 1 is a schematic diagram of an access control system.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 illustrates an access control system 10 including a plurality of electronic access devices 20 in the form of wireless door locks for use on an entrance door of a building, room or another part of a structure. Additionally, the access control system 10 includes a plurality of door operators 21. In some embodiments, one or more of the access devices 20 is located at a door not having a door operator 21. In other embodiments, one or more of the access devices 20 is located at a door having a door operator 21. Each of the access devices 20 and the door operators 21 are configured to receive RF signals as part of an RF network 22, 24 and 26. While access devices 20, and in particular door locks, are illustrated and described, it should be understood that other locking devices, including exit devices such as crash bars and push pads, are also contemplated for use in association with the invention.

The door locks 20 and door operators 21 are also configured to send and receive signals to computer network 12 via a WI-FI connection 26. It should be understood that many other devices, in other embodiments, send and receive RF signals as part of the RF network 24 and WI-FI connection 26, and that the illustrated door lock and door operator are simply examples of one of these devices. The received RF signals received by the door lock and the door operators are configured to change or modify the operating conditions or operating status of the door lock, the door operator, and the door. For instance, the operating status includes a door open position, a door closed position, any position between the door open and closed positions, and a door lock in a locked state and an unlocked state. Other communication protocols are also contemplated as falling within the scope of the present disclosure.

In the RF network 22, each door operator 21 acts as a communication node that receives a radio signal from an access control device 30 through its assigned bridge device 14, also described as a panel interface module. In other embodiments, the access control device communicates directly with the door operators 21. The access control device 30 is configured to provide system instructions and to receive signals from both the interface modules 14 and 16. Each of the interface modules 14 and 16 is generally positioned within a predetermined communication distance of certain door operators 21. Each of the interface modules includes an antenna, such as an antenna 17 of the interface module 16. In one embodiment, the interface modules 14 and 16 are connected by a hardwired connection 18. The door locks 20 and the door operators 21 communicate to send and receive information packets via the RF network or via a WI-FI connection 22 with computer network 12 to other devices in the system 10, such as the access control device 30. In other embodiments, the system instructions are located at a server facility maintained by a manufacturer, an installer, or a third party where the facility includes one or more servers serving unassociated users, often referred to as "cloud" computing facilities.

Figure 2:
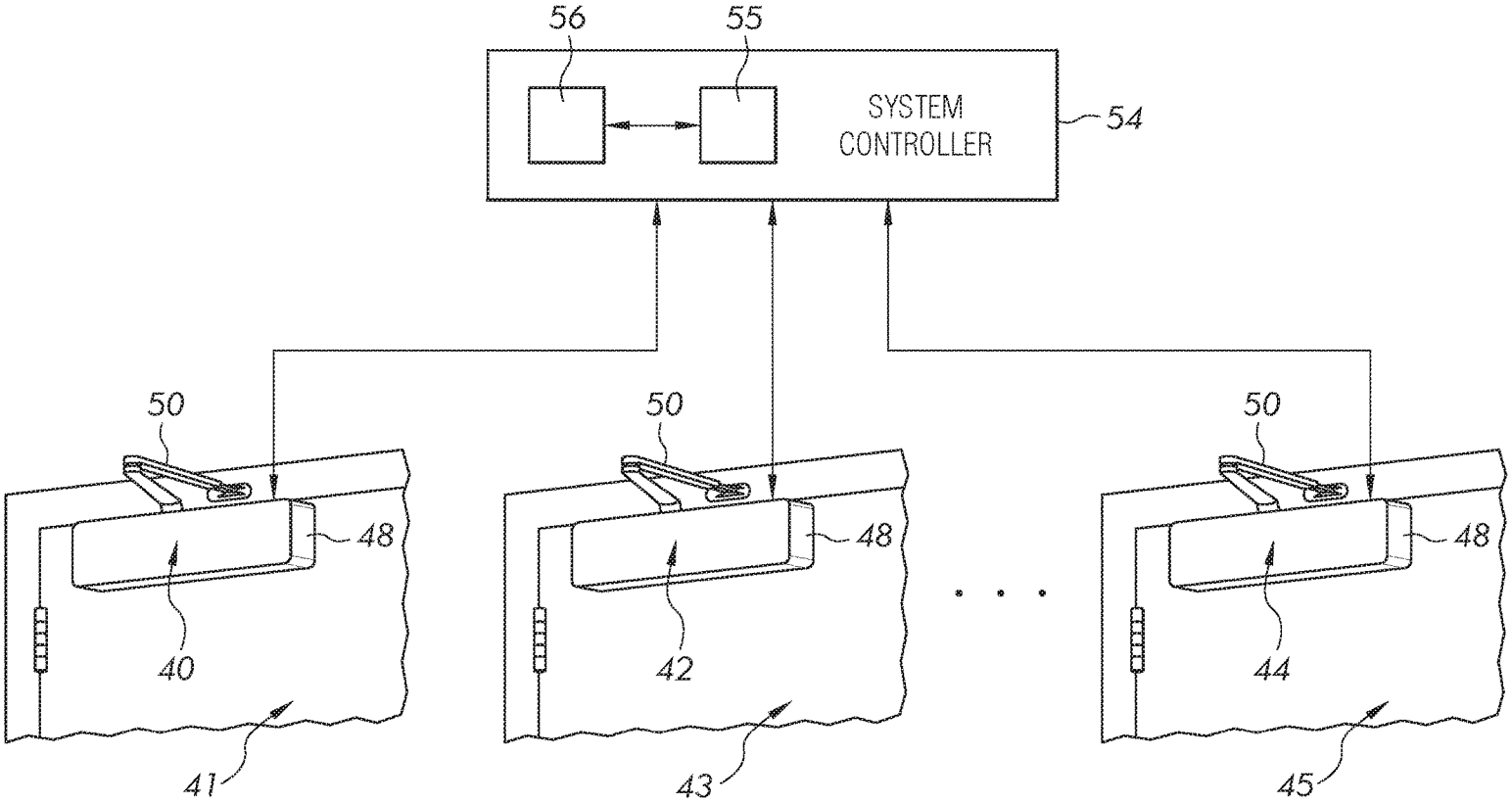
FIG. 2 is schematic diagram of an access control system including a system controller and a plurality of door operators each located at a door.

With reference to FIG. 2, there is illustrated a schematic diagram of the access control system 10 including a first door operator 40 located at a first door 41, a second door operator 42 located at a second door 43, and a third door operator 44 located at a third door 45. While three doors each having a door operator are shown, the present disclosure is not limited to three door operators, but any number of door operators are possible, including a single door operator.

Each of the door operators includes a housing 48 and an arm 50 operatively connected to the housing 48 and to the frame of each of the doors. Each of the door operators is configured to open and/or close the door, or to locate the door at any position between the open and closed position, when provided an instruction. The instruction can be provided remotely or locally. If the instruction is provided locally, a user interface button, either mechanical or touch sensitive, is pressed, or a card reader senses a credential to operate the door, such as provided by the door locks 20 of FIG. 1. In other embodiments, the instruction is provided by a non-contact sensor, such as a motion sensor of a predetermined type which responds to a wave of a hand or another type of intentional act.

In the illustrated embodiment, instructions are provided remotely by a system controller 54, or an access control device 30 in another embodiment. The system controller 54 is in communication with each of the door operators 40, 42 and 44 and provides instructions to change the status of each of the door operators. In other embodiments, the system controller 54 maintains the current status of one or more of each of the door operators. The system controller 54 also monitors the status, state or condition of each of the door operators and/or the door locks. The controller 54 includes a processor 55. In addition, the status of the each of the doors is determined, in part, by a schedule located in a memory 56 of the system controller by a user or administrator, to schedule a change in status or condition of each the door operators, and therefore a respective door, at a predetermined time. In another embodiment, the system controller 54 is provided in one or more of the door operators.

Figure 3:
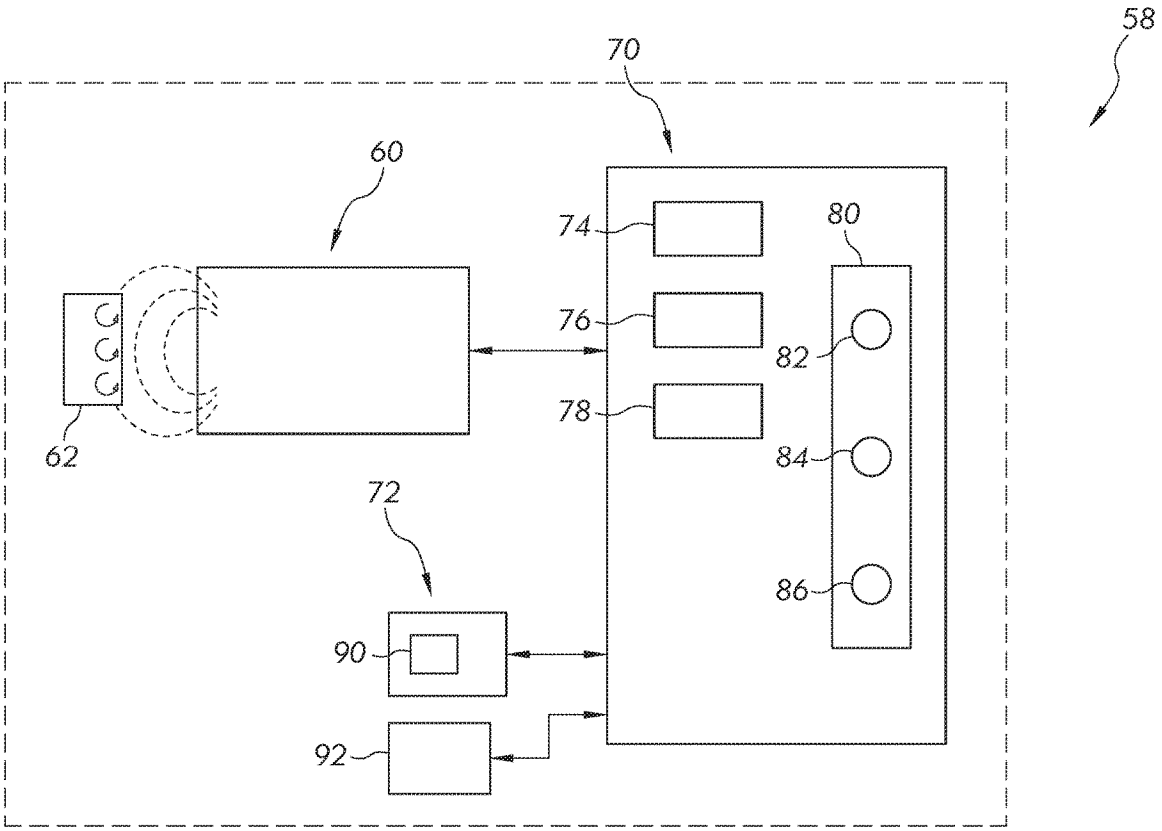
FIG. 3 is a block diagram of a door operator device.

As shown in FIG. 3, each of the door operators includes within the housing 48 a door operator system 58 including a sensor 60 configured to interact with a target 62. In one embodiment, the target 62 is a conductive target configured to be sensed by the sensor 60, which in one embodiment is an inductive sensor. The target 62 is located on the arm 50 or door frame such that movement of the door moves the sensor 60 with respect to the conductive target 62 to sense the location of the door with respect to the door frame. As would be appreciated by those having skill in the art, an alternating current flowing through the inductor 60 generates a magnetic field by which the target 62 is inductively linked.

Interaction of the sensor 60 with the target 62 is a function of the distance, size and composition of the target 62. Thus, changes in the distance, position and/or orientation of the target 62 with respect to inductive coil sensor 60 causes a variation in the sensed position of the target 62 with respect to the sensor 60. The sensor 60 is configured to generate an output signal corresponding to one or more of the variable characteristics affected by interaction between the sensor 60 and the target 62. In one embodiment, the sensor 60 provides a signal to a controller 74 located in the housing 48, which determines from the signal an angular position of each of the doors 41, 43 and 45, with respect to the respective frames. In other embodiments, the sensor 60 is a mechanical sensor and the target 62 engages the sensor 60 at a mechanical interface between the sensor and the target.

A controller 70 is in communication with the sensor 60, and is in further communication with an actuation mechanism 72. As illustrated, the controller 70 includes a processor 74, a sensor unit 76, a determining unit 78, and a memory 80. As described in further detail below, the sensor unit 76 is configured to activate the sensor 60 and to receive data from the sensor 60. The determining unit 78 is configured to determine an angular position of the door using information received from the sensor 60.

The memory 80 is a non-transitory computer readable medium having data stored thereon, and is in communication with the processor 74. The data stored on the memory 80 may include, for example, one or more sets of instructions 82, one or more look-up tables 84, and/or additional data 86. The instructions 82 may be executed by the processor 74 to cause the processor 74 to perform one or more functions such as, for example, the functions associated with one or more of the described units. While the illustrated controller 70 is housed within the housing 48, it is also contemplated that the controller 70 may be positioned elsewhere on the operator system 58 or externally to the operator system 58.

The processor 74, in different embodiments, is a programmable type, a dedicated, hardwired state machine, or a combination of these, and can further include multiple processors, Arithmetic-Logic Units (ALUs), Central Processing Units (CPUs), Digital Signal Processors (DSPs) or the like. Other forms of processor 74 include multiple processing units, distributed, pipelined, and/or parallel processing. The processor 74 may be dedicated to performance of the operations described herein or may be utilized in one or more additional applications. In the depicted form, the processor 74 is of a programmable variety that executes algorithms and processes data in accordance with defined by programmed instructions (such as software or firmware) stored in memory 80. Alternatively or additionally, the operating logic for processor 74 is at least partially defined by hardwired logic or other hardware. The processor 74, in different embodiments, is comprised of one or more components of any type suitable to process the signals received from input/output devices, and provide desired output signals. Such components may include digital circuitry, analog circuitry, or a combination of both.

The memory 80 includes one or more types, such as a solid-state variety, electromagnetic variety, optical variety, or a combination of these forms. Furthermore, the memory 80 includes, in different embodiments, volatile, nonvolatile, or a combination of these types, and a portable variety, such as a disk, tape, memory stick, cartridge, or the like. In addition, the memory 80 is configured to store data that is manipulated by the operating logic of the processor 74, such as data representative of signals received from and/or sent to the door operator in addition to or in lieu of stored program instructions, just to name one example.

The actuation mechanism 72 is configured to control the rotational speed of the door during opening and/or closing events. The actuation mechanism 72 may alternatively be referred to as a pinion control mechanism or a speed regulating mechanism. The actuation mechanism 72 may include an actuator 90 configured to perform actions in response to commands from the controller 70. The actuator 90 may, for example, be an electromechanical actuator such as a motor, solenoid or electromechanical valve.

The operator system further includes a multi-frequency transceiver 92 (receiver and transmitter), that can include an RF module having an antenna or programmable card for the reception and transmission of sub 1-GHz RF signals, a WI-FI module configured to establish a WI-FI connection to send and receive WI-FI signals to the computer network 12, and all necessary electronic components required for the reception and generation of RF signals and WI-FI connection/disconnection with logic-memory module 70. In addition, the transceiver 92, in different embodiments, is configured to communicate with some or all of the operator systems 58 of each of the plurality of door operators 40, 42 and 44. In other embodiments, the transceiver 92 is configured to transmit and to receive signals having other frequencies, including ultrasonic frequencies and frequencies equal to or greater than 1 GHz.

In different embodiments, the operator system 58 includes a plurality of door operation devices which are adjustable to alter the operating characteristics of the operator 58, which in turn adjusts the operation characteristics of the door in opening and closing cycles. The door operation devices include door opening and closing cycle devices, including an opening speed device, a back check speed device, a hold open time device, a delay device, a closing speed device, a latch position device, and a back check position device.

Figure 4:
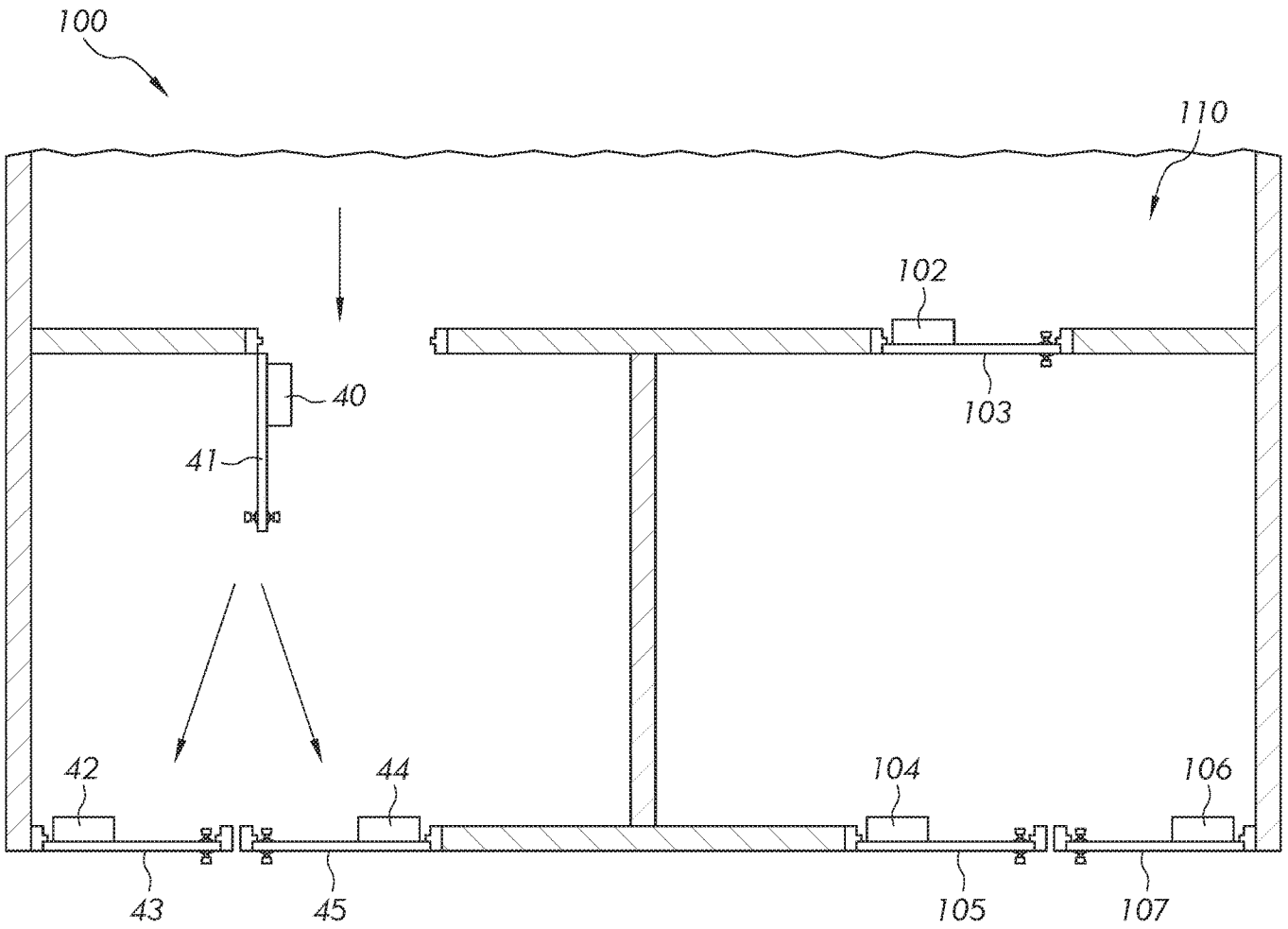
FIG. 4 illustrates one example of a plurality of door operators coupled to respective doors installed in a facility.

FIG. 4 illustrates one example of an installed access control system 100 having the door operators 40, 42 and 44, and additional door operators including door operator 102 coupled to a door 103, door operator 104 coupled to a door 105, and a door operator 106 coupled to a door 107. Other devices included in the access control system 100 are not illustrated, but may include those illustrated and described in association with FIG. 1 and as further described elsewhere in this disclosure. Each of the illustrated door operators includes the door operator system 58 of FIG. 3. The access control system 100, in this embodiment, is used to control the operation of each of the door operators, and the doors to which each is attached.

In the exemplary installation, the door operators are located at a plurality of doors providing for entry and exit to a room 110 having doors 41 and 103 immediately adjacent to the room 110, and doors 43, 45, 105 and 107 which provide an exit to an exterior 112 of a building. Assuming that the door 103 is locked and people are exiting the building, each of the individuals will move through the door 41 and move through either of the doors 43 or 45.

The present disclosure provides for an optimized exit from the facility such that movement of the doors from a closed position to an open position adjusts to the flow of people leaving the facility. Since each of the door operators includes a door operator system 58, the current status of each of the doors is provided to the system controller 54. The system controller 54, which receives transmitted information from each of the door operator systems 58, is configured to adjust the doors such that the control of the position of each of the doors is essentially transparent to those leaving, so that people flowing through the door openings are not inconvenienced. By incorporating the information from multiple door closers, the present disclosure facilitates a more natural flow of the occupants. For example, if exits are operating at times of high egress from a building, for instance at the end of a show or event, each of the doors 43 and 45 can be moved to the open position so that individuals leaving do not have to hold the door open. Smoother egress from the building is thereby accomplished if people do not have to hold open the doors for others as the doors attempt to close. Initially, the doors 43 and 44 may not be held open and attempt to close, but as other doors are triggered by an exit, easier egress is facilitated by the triggering events. A change in door status is based on a "learning" determined the system controller 54 as a result of the exiting occurring after an event.

In another embodiment, the system changes a schedule based on a "learning" which occurs during a predetermined time period. For instance, the learning feature is turned on only during a certain time period of day when foot traffic through a door is high. In another embodiment, the "learning" feature is turned on all the time to capture traffic flow at all times and to adjust the schedules as necessary. In still another embodiment, even if the learning feature is turned on only at a specific time, the system is configured to learn at all time, but only configured to adjust the schedules for the designated time period.

In some embodiments, the learned schedule is stored in a memory accessible by one or more other door operator systems which are located at other locations within a facility or at other facilities. Usage patterns shown by the schedules are accessed by the other systems and provide additional information which is used by the other systems in making schedules. Additionally, the monitored door operator statuses can be used to determine when maintenance is required. This information is used by other buildings with door operator systems to provide maintenance in those facilities, if required maintenance is shown by the shared schedule. This information can also be accessible by a hardware manufacturer or hardware installer to monitor system reliability.

Figure 5:
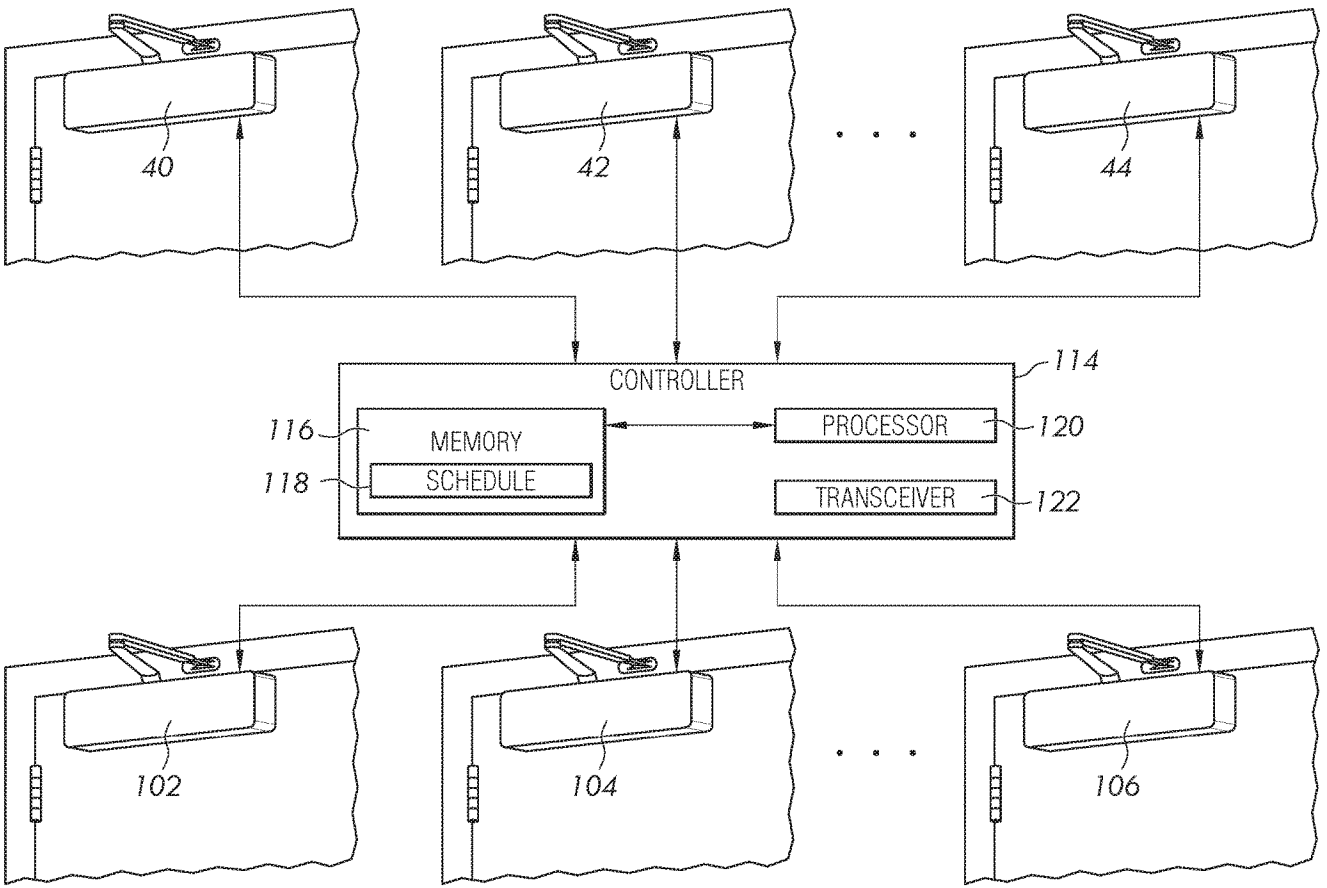
FIG. 5 is a schematic diagram of an access control system of the facility of FIG. 4.

In an initial installation of the access control system 100, a controller 114, such as that illustrated in FIG. 5 and further described herein in association with FIGS. 1 and 2, includes a memory 116 configured to store a schedule 118 provided, for instance, by an installer of the system. In another embodiment, a system administrator is authorized to prepare and to change the schedule 118. In still another embodiment, the schedule is automatically configured according to a set of rules provided in memory. The controller 114 includes a processor 120 operatively coupled to the memory 116. A transceiver 122 is coupled to the processor and transmits and receives door status information from each of the door operators 124, each of which includes a door operator system 58 such as that illustrated in FIG. 3.

The controller 114 executes or otherwise relies upon computer software applications, components, programs, objects, modules, or data structures. Software routines resident in the memory 116 are executed in response to the signal received from each of the door operators 40, 42, 44, 102, 104 and 106. The executed software includes one or more specific applications, components, programs, objects, modules or sequence of instructions typically referred to as "program code". The program code includes one or more instructions located in memory 116 and other storage devices which execute the instructions located in memory.

In one embodiment, each of the features is controlled by program code which is resident at the system controller 114. The memory 116 includes a software library including a plurality of software packages or components, each one corresponding to one of the door operators. In another embodiment, the memory includes a software package configured to identify each of the door operators. The controller 114 receives one or more signals from each of the door operators which provide a current status of each of the doors. Upon receipt of the current status, the processor 120 determines whether the status of one or more of the door operators should be maintained or changed.

Figure 6:
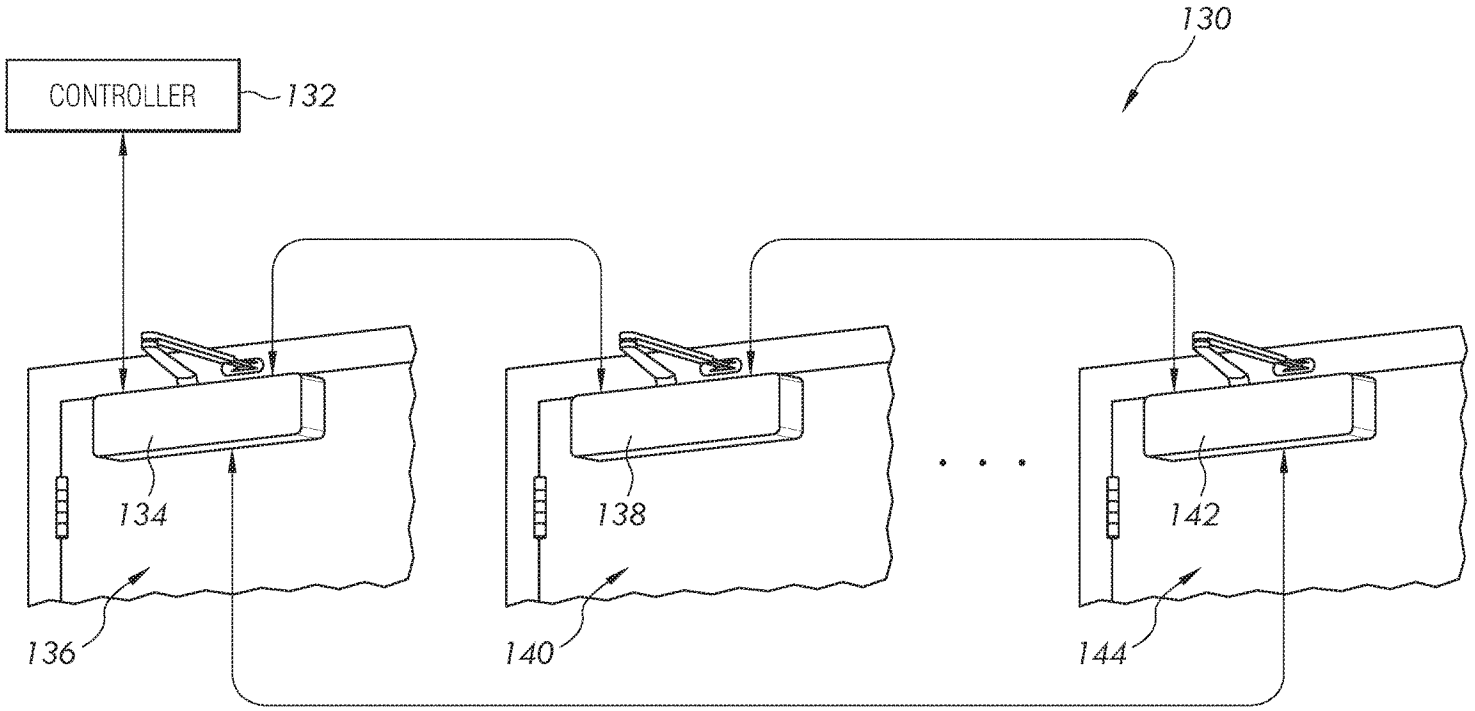
FIG. 6 is a schematic diagram of another embodiment of an access control system.

FIG. 6 illustrates a schematic diagram of another embodiment of an access control system 130. In this embodiment, the access control system includes a system controller 132 operatively connected to a first door operator 134 located at a door 136. A second door operator 138 is located at a door 140 and a third door operator 142 is located at a door 144. The first door operator 132 is the only one of the illustrated door operators which communicates directly with the controller 132 using communication protocols as described herein. Each of the remaining door operators communicates with one of the other door operators, but does not directly communicate with the controller 132. In one example, door operator 138 communicates directly with door operator 134 and 142, and door operator 142 communicates directly with door operators 134 and 138. The status of each of the door operators 138 and 142 is thereby transmitted to the door operator 134 for further transmission to the controller 132. In addition, door operator instructions provided by the controller 132 are transmitted directly and only to the door operator 134 which in turn transmits the provided instructions to one or both of the remaining door operators 138 and 142.

In another embodiment, the door operators are configured to communicate with a closest door operator in a "daisy chain" fashion such that only one of the door operators communicates with a last door operator in the daisy chain, which in turn communicates with the controller 132. In still another embodiment, one of the door operators includes the controller 132, such that one of the door operators includes a master controller and the remaining door closers each include a slave controller. Consequently, depending on the configuration of the facility in which the access control system is located, each of the door operators either communicates directly with the system controller or one of the other door operators.

The door intelligence (i.e., the sensed door status) for the operation and/or maintenance of each door operator is provided to the system controller, which is configured in different embodiments as a central server, a remote server or by a cloud services provider.

Figure 7:
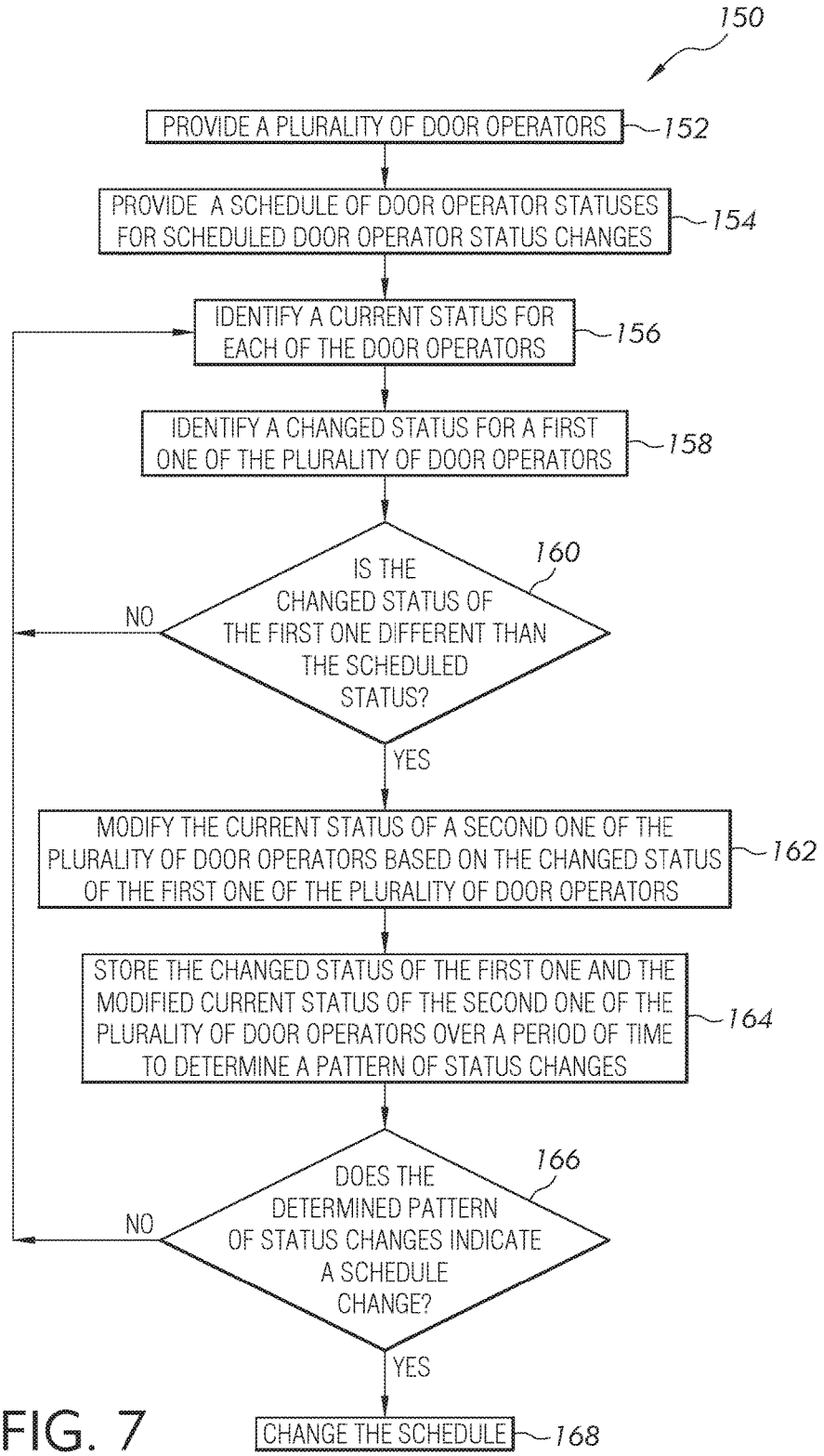
FIG. 7 is a block diagram of a process to control a status of one or more doors.

FIG. 7 illustrates a block diagram of one embodiment of a process 150 to control a status of one or more door operators and a related door. Initially, a plurality of door operators, which are included in a door operator system such as that disclosed herein, are provided at block 152. Once provided, a schedule of door operator statuses for scheduled door operator status changes are provided at block 154. The schedule is determined by a manufacturer, an installer or an access system administrator, or others, based on the installed locations for each of the door operators. For instance, if the access control system is installed at a high school facility having a predetermined class schedule, the schedule is established to open and close doors within the facility at predetermined times. The door open and close schedule is determined based on when the classes end and when classes begin. In another example for accommodating a school convocation, the door open and close schedule is established to direct the students toward the convocation hall. Doors not leading to the convocation hall are not opened.

Once the schedule is provided, the access control system operates in a status mode where a current status of each of the door operators is identified at block 156. The access control system continues to monitor the status and identifies a changed status for any one of the door operators at block 158. If the changed status is not different than the scheduled status as determined at block 160, the process returns to block 156 where the current status for each of the door operators continues to be monitored. If, however, the changed status is different than the scheduled status, then a current status of another door operator is or may be modified at block 162. In one example, when the school convocation is dismissed and students return to the classrooms, at some point the door status is scheduled to change. The status changes from a door open status to a door closed status after a predetermined period of time when it is presumed that all students should have returned to a classroom. If the individuals leaving the convocation are, however, more numerous than those attending previous convocations, one or more of the doors may be held open longer than scheduled. In this case, additional doors are held open longer or new door doors are opened to accommodate the increased traffic.

Once the current status has been modified, the changed status of the first door and the modified status of a second door are stored in memory at block 164. These stored status changes, in one embodiment, are used to adjust the schedule of the door operators. In another embodiment, the stored status changes are compared to later-saved stored status changes to determine if the stored schedule should be modified at block 166. In some cases, the status changes are found not to repeat often enough, and consequently the schedule is not adjusted. The process then returns to block 156. In instances where the status changes predictably repeat, then the schedule is changed at block 168 to reflect the new pattern of use. In one embodiment, the schedule is automatically changed by the system controller. In another embodiment, the system administrator is notified that the schedule should be reviewed to determine if a change should be made.

The system controller or individual door operator controllers are configured to modify the operation of any one of the door operators based on the sensed data provided by sensors located at any one of the door operators or at any one of the doors. In different embodiments, the system controller or the door operator controller adjusts the door status according to any one, some of, or all of the following additional examples. The system controller is not limited to adjusting door operators with respect to the following examples and such examples are not considered to be limiting.

Example 1

The door opening time is extended if two or more exits are held open by more than a predetermined number of seconds (i.e., either with the doors that are open or exit devices that are opened in addition to the initial doors).

Example 2

If doors attempt to close or partially close, but are reopened by an exiting person, an extension of the hold open instruction is communicated by the system controller to other devices that are in the open state or are activated.

Example 3

If a pattern of door statuses emerges, the system controller adjusts predetermined operating conditions automatically, or sends an alert with a recommended change to a system administrator.

Example 4

Detect and/or respond to a maintenance issue and provide an alternative. For instance, if a door is not operating properly due to a malfunctioning door operator, the movement of persons moving through the facility is rerouted through other doors.

Example 5

The system controller responds to a stored maintenance schedule when maintenance is due. Should a door not be operating properly, the system controller adjusts the maintenance schedule and/or provides an alert signal for a system administrator to take corrective action.

Example 6

The system controller monitors other sensor inputs to modify operation of one or more of the doors and associated door operators. For instance, the sensors include pressure sensors (HVAC), rain/snow sensors, and fire system sensors. In other embodiments, the sensors include accelerometers, compass chips (magnetometers), door angle sensors, and door open/door closed sensors. Still other sensors include sensors to monitor the presence of individuals moving through a door such as motion sensors and people counter sensors.

Example 7

The system controller includes a fail-safe mode which adjusts the status of each of the door operators and/or the door lock should a communication/component outage occur.

Example 8

If an exception occurs, such as if a student props open a door making it unable to close on its own according to the predetermined schedule, an alert is generated by the system. Once an alert is generated the system administrator or other person having the appropriate authority level, identifies the door condition as a one-time exception which is not accepted as a "learning" to be used in a revised schedule.

Example 9

The system controller overrides any door function which is different than the scheduled function, with an emergency condition overriding the currently scheduled function of a door operator. For instance, if a mechanical device for locking has locked the door, such as a mechanical deadbolt, and the system attempts to open the locked door, the system would stop making the attempt to unlock the door. In one embodiment, an alert is provided indicating an unscheduled condition. This could reduce the potentiality of a running out a motor which attempts to open the door continuously. The system could attempt to open the door on a less frequent basis until the mechanical condition has changed.

Any one, some of, or all of the software, algorithms, data processes, and data used by or determined by the controllers and memories described herein can be stored in the cloud or other devices not specifically located at a door, a door frame, a wall located next to a door, or even in the same facility.

The present disclosure improves upon the current door access control systems by increasing the ability to detect a variety of door operations and patterns of door operations. By collecting door operator data and other door sensor data, various data points are provided to improve the knowledge available about the state of a door.

It is contemplated that the various aspects, features, computing devices, processes, and operations from the various embodiments may be used in any of the other embodiments unless expressly stated to the contrary.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. For instance, while a pivoting door is shown, other door configurations are possible including sliding doors and doors on tracks.

What is claimed is:

1. A method of operating a plurality of door operators that are each configured to control a status of a door, the method comprising:

identifying a current status of each of the plurality of door operators;

identifying a changed status for at least one of the plurality of door operators;

modifying or maintaining the current status of at least one other of the plurality of door operators based on the changed status; and providing a schedule of door operator statuses including a plurality of scheduled status changes scheduled over a period of time for each door operator.

2. The method of claim 1, wherein each of the current status and the changed status includes one of a door open status, a door closed status, a door locked status, a door unlocked status, and a door change in direction status.

3. The method of claim 1, wherein the identifying the changed status includes identifying the changed status for each of the plurality of doors.

4. The method of claim 3, further comprising storing the identified changed status for each of the plurality of doors.

5. A method of operating a plurality of door operators that are each configured to control a status of a door, the method comprising:

identifying a current status of each of the plurality of door operators;

identifying a changed status for at least one of the plurality of door operators;

modifying or maintaining the current status of at least one other of the plurality of door operators based on the changed status; and providing a schedule of door operator statuses, wherein the provided schedule includes a plurality of scheduled status changes scheduled over a period of time for each door operator; and wherein the scheduled status change is configured to modify or maintain the current status of a door operator.

6. The method of claim 5, further comprising determining a pattern of the identified changed status for the at least one of the plurality of door operators; and providing a modified schedule of door operator statuses.

7. The method of claim 6, further comprising adjusting the plurality of door operators based on the modified stored schedule.

8. A method of operating a plurality of door operators that are each configured to control a status of a door, the method comprising:

identifying a current status of each of the plurality of door operators;

identifying a changed status for at least one of the plurality of door operators; and modifying or maintaining the current status of at least one other of the plurality of door operators based on the changed status; and providing a plurality of sensors at each of the doors, wherein the plurality of sensors includes at least one of a pressure sensor providing a pressure signal, an environment sensor providing an environmental signal, a heat sensor providing a heat signal, a smoke sensor providing a smoke signal, a motion sensor providing a motion signal, an accelerometer providing an acceleration signal, and a people counter providing a count of people; and wherein each of the current status and the changed status includes one of a door open status, a door closed status, a door locked status, a door unlocked status, and a door change in direction status.

9. The method of claim 8, further comprising providing a schedule of door operator statuses, wherein the stored schedule includes a plurality of scheduled status changes scheduled over a period of time for each door operator; and wherein the scheduled status change is configured to modify or maintain the current status of a door operator.

10. The method of claim 9, further comprising overriding the schedule of door operator statuses based on a receipt of one of the signals from one of the plurality of sensors.

11. A method of operating a plurality of door operators that are each configured to control a status of a door, the method comprising:

providing a plurality of door operators configured to be located at one of a plurality of doors;

providing a schedule for door operator statuses, wherein the schedule is configured to include a plurality of scheduled status changes scheduled over a period of time for each door operator, and wherein the scheduled status changes are configured to modify the status of a door operator;

identifying a current status of each of the plurality of door operators;

identifying a changed status for a first portion of the plurality of doors; and modifying or maintaining the current status of a second portion of the plurality of doors based on the identified changed status.

12. The method of claim 11, further comprising determining a pattern of the identified changed status; and modifying the schedule of door operator statuses based on the changed status.

13. The method of claim 12, further comprising adjusting the plurality of door operators based on the modified stored schedule.

14. The method of claim 13, further comprising providing a plurality of sensors with at least one disposed at each of the doors, wherein the plurality of sensors includes at least one of a pressure sensor providing a pressure signal, an environment sensor providing an environmental signal, a heat sensor providing a heat signal, a smoke sensor providing a smoke signal, a motion sensor providing a motion signal, an accelerometer providing an acceleration signal, and a people counter providing a count of people.

15. The method of claim 14, further comprising overriding the schedule of door operator statuses based on a receipt of one of the signals from one of the plurality of sensors.

16. An access control system for controlling the status of a plurality of doors according to a method of operating a plurality of door operators that are each configured to control a status of a door, the method comprising:

identifying a current status of each of the plurality of door operators;

identifying a changed status for at least one of the plurality of door operators; and modifying or maintaining the current status of at least one other of the plurality of door operators based on the changed status; and wherein the access control system comprises:

the plurality of door operators configured to change the status of the plurality of doors, wherein each of the door operators includes an actuator, a sensor, a transceiver, and processor operatively connected to the actuator, the sensor, and the wireless transceiver; and a master controller operatively connected to each of the plurality of door operators, wherein the master controller includes a memory configured to store program instructions, the master controller configured to execute the stored program instructions to perform the steps of identifying the current status of each of the plurality of door operators, identifying the changed status for the at least one of the plurality of door operators, and modifying or maintaining the current status of the at least one other of the plurality of door operators based on the changed status.

17. The access control system of claim 16, wherein the master controller is further configured to execute stored program instruction to change the status of each of the doors based on a schedule of door operator statuses, wherein the schedule includes a plurality of scheduled door operator status changes scheduled over a period of time for each door operator to change the status of the door operator at a predetermined time.

18. The access control system of claim 17, further comprising a plurality of sensors with at least one of the plurality of sensors disposed at each of the doors, wherein the plurality of sensors includes at least one of a pressure sensor providing a pressure signal, an environment sensor providing an environmental signal, a heat sensor providing a heat signal, a smoke sensor providing a smoke signal, a motion sensor providing a motion signal, an accelerometer providing an acceleration signal, and a people counter providing a count of people.

19. The access control system of claim 16, wherein the identifying a changed status includes identifying a time period over which the identified changed status occurs.

20. The access control system of claim 19, wherein the modify the current status of at least one other of the plurality of door operators includes modifying the current status based on the identified time period.

21. The access control system of claim 16, wherein the identifying a changed status includes identifying a changed status from a closed position to an open position, and wherein the modifying the current status of the at least one other of the plurality of door operators includes modifying the current status from a closed position to an open position after the at least one of the plurality of door operators has changed to the open position.

22. The access control system of claim 21, further comprising modifying the status of the at least one of the plurality of door operators changes from the open position to the closed position after the at least one other of the plurality of door operators changes to the open position.

23. A method of operating a plurality of door operators that are each configured to control a status of a door, the method comprising:

identifying a current status of each of the plurality of door operators;

identifying a changed status for at least one of the plurality of door operators;

modifying or maintaining the current status of at least one other of the plurality of door operators based on the changed status;

providing a schedule of door operator statuses;

providing at least one sensor at each of the doors; and overriding the schedule of door operator statuses based on receipt of a signal from the sensor.

24. A method of operating a plurality of door operators that are each configured to control a status of a door, the method comprising:

identifying a current status of each of the plurality of door operators;

identifying a changed status for at least one of the plurality of door operators;

modifying or maintaining the current status of at least one other of the plurality of door operators based on the changed status; and providing at least one sensor at each of the doors, wherein the at least one sensor includes a pressure sensor providing a pressure signal, an environment sensor providing an environmental signal, a heat sensor providing a heat signal, a smoke sensor providing a smoke signal, a motion sensor providing a motion signal, an accelerometer providing an acceleration signal, and a people counter providing a count of people.

* * * * *